US007467610B2

(12) United States Patent
Fujii et al.

(10) Patent No.: US 7,467,610 B2
(45) Date of Patent: Dec. 23, 2008

(54) VALVE-OPERATING SYSTEM FOR INTERNAL COMBUSTION ENGINE

(75) Inventors: Noriaki Fujii, Wako (JP); Keiko Yoshida, Wako (JP); Tomoya Fujimoto, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 29 days.

(21) Appl. No.: 11/399,602

(22) Filed: Apr. 7, 2006

(65) Prior Publication Data

US 2006/0236962 A1 Oct. 26, 2006

(30) Foreign Application Priority Data

Apr. 19, 2005 (JP) ..... 2005-120744

(51) Int. Cl.
*F01L 1/34* (2006.01)

(52) U.S. Cl. ..... 123/90.16; 123/90.15; 123/90.17; 123/90.2; 123/90.31; 123/90.44

(58) Field of Classification Search ..... 123/90.16
See application file for complete search history.

(56) References Cited

U.S. PATENT DOCUMENTS 6,705,256 B2 * 3/2004 Yamaki et al. ..... 123/90.11
6,948,465 B2 * 9/2005 Daigo et al. ..... 123/90.16
2006/0236963 A1 * 10/2006 Fujii et al. ..... 123/90.16

FOREIGN PATENT DOCUMENTS

JP 11-81947 3/1999
JP 2004-36560 2/2004

* cited by examiner

*Primary Examiner*—Thomas Denion
*Assistant Examiner*—Kyle M Riddle
(74) *Attorney, Agent, or Firm*—Kratz, Quintos & Hanson, LLP

(57) ABSTRACT

A valve-operating system for an internal combustion engine includes cam followers which have cam abutment portions abutting against valve-operating cams provided on a camshaft and which are swingably carried in an engine body and operatively connected to engine valves biased in a closing direction by a valve spring. The cam followers are biased in a direction of abutment of the cam abutment portions against the valve-operating cams by a resilient biasing means different from the valve spring. A resilient biasing means includes a pull rod connected at one end thereof to the cam follower, and a compression coil spring interposed between the other end of the pull rod and the engine body to pull the pull rod to bias the cam follower in a direction of abutment of the cam abutment portion against the valve-operating cam. Thus, the resilient biasing means is constructed to be compact, leading to an increase in degree of freedom of the design of the structure of the valve-operating system.

2 Claims, 10 Drawing Sheets

FIRST INTAKE VALVE

SECOND INTAKE VALVE

VALVE-OPERATING SYSTEM FOR INTERNAL COMBUSTION ENGINE

RELATED APPLICATION DATA

The Japanese priority application No. 2005-120744 upon which the present application is based is hereby incorporated in its entirety herein by reference.

BACKGROUND OF THE INVENTION

1. Field of the Invention

The present invention relates to a valve-operating system for an internal combustion engine, comprising cam followers which have cam abutment portions abutting against valve-operating cams provided on a camshaft and which are swingably carried in an engine body and operatively connected to engine valves biased in a closing direction by a valve spring, the cam followers being biased in a direction of abutment of the cam abutment portions against the valve-operating cams by resiliently biasing means different from the valve spring.

2. Description of the Related Art

Japanese Patent Application Laid-open 2004-36560 discloses a lift-variable valve-operating system in which a pair of link arms are turnably connected, each at one end thereof to a cam follower, one of the link arms being turnably carried at the other end thereof by a stationary support shaft, and the other link arm being turnably carried at the other end thereof by a movable support shaft having an axis parallel to the stationary support shaft, in order to continuously change the valve-opening lift amount of an engine valve. In this valve-operating system, the one link arm and the cam follower are resiliently biased in a direction of abutment of a cam abutment portion of the cam follower against a valve-operating cam of a camshaft by a torsion spring surrounding the stationary support shaft. Also, Japanese Patent Application Laid-open 11-81947 discloses a valve-operating system in which the operational characteristic of an engine valve can be changed, and a cam follower is biased by a compression coil spring in a direction of abutment of a cam abutment portion against a valve-operating cam of a camshaft.

However, in the lift-variable valve-operating system disclosed in Japanese Patent Application Laid-open 2004-36560,a space for disposition of the torsion spring is relatively large in a direction along the axis of the stationary support shaft, so that the space for disposition of the torsion spring cannot be secured in some cases in terms of reduction in size of the internal combustion engine. Also, as disclosed in Japanese Patent Application Laid-open 11-81947, even if the valve-operating system is designed so that the cam follower is biased by the compression coil spring in such a manner that the cam abutment portion is brought into abutment against the valve-operating cam, it may be difficult in some cases to dispose the compression coil spring, because the compression coil spring interferes with a member disposed around the cam follower.

SUMMARY OF THE INVENTION

Accordingly, it is an object of the present invention to provide a valve-operating system for an internal combustion engine, wherein the resiliently biasing means is compactly constructed so that the degree of freedom of the design of the structure of the valve-operating system can be increased.

In order to achieve the above object, according to a first feature of the present invention, there is provided a valve-operating system for an internal combustion engine, comprising cam followers which have cam abutment portions abutting against valve-operating cams provided on a camshaft and which are swingably carried in an engine body and operatively connected to engine valves biased in a closing direction by a valve spring, the cam followers being biased in a direction of abutment of the cam abutment portions against the valve-operating cams by resilient biasing means different from the valve spring, wherein each of the resilient biasing means comprises: a pull rod connected at one end thereof to the cam follower; and a compression coil spring interposed between the other end of the pull rod and the engine body to pull the pull rod to bias the cam followers in a direction of abutment of the cam abutment portions against the valve-operating cams.

With the first feature, the pull rod is pulled by the spring force exhibited by the compression coil spring, whereby the cam follower is biased in the direction of abutment of its cam abutment portion against the valve-operating cam. The resilient biasing means for biasing the cam follower in the direction of abutment of the cam abutment portion against the valve-operating cam has a compact structure, leading to an increase in the degree of freedom of the design of the structure of the valve-operating system.

According to a second feature of the present invention, in addition to the first feature, a pair of link arms are connected, each at one end thereof to the cam follower; the other end of one of the link arms is turnably carried in the engine body through a stationary support shaft having an axis parallel to an axis about which the cam follower is swung; the other end of the other link arm is turnably carried by a movable support shaft which has an axis parallel to the stationary support shaft and which is movable within a plane perpendicular to the axis; and the resilient biasing means are mounted between the one link arm and the engine body.

With the second feature, in the valve-operating system designed so that the lift amount of the engine valve is changed by displacing the movable support shaft, the looseness of a link mechanism comprising the cam followers and the pair of link arms is suppressed, thereby suppressing vibration generated in the valve-operating system.

Rocker arms 26 and 27 in an embodiment correspond to the cam followers of the present invention; rollers 36 and 46 in the embodiment correspond to the cam abutment portions of the present invention; and intake valves V1 and V2 in the embodiment correspond to the engine valves of the present invention.

The above and other objects, features and advantages of the invention will become apparent from the following description of the preferred embodiment taken in conjunction with the accompanying drawings.

DETAILED DESCRIPTION OF PREFERRED EMBODIMENT

The present invention will now be described by way of one embodiment with reference to the accompanying drawings.

Figure 1:
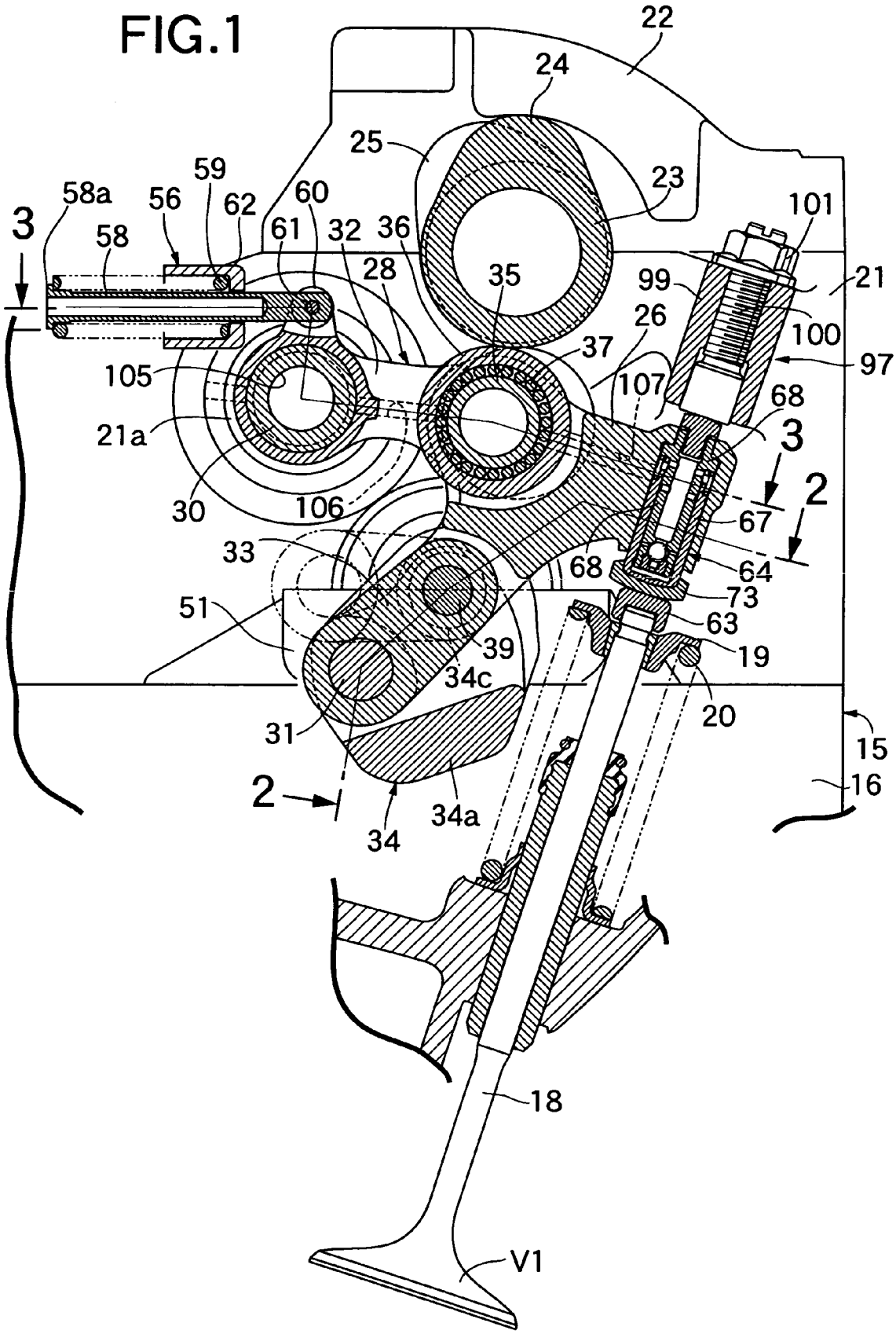
FIG. 1 is a vertical sectional view of a valve-operating system for an intake valve, taken along lines 1-1 in FIGS. 2 and 3.
Figure 2:
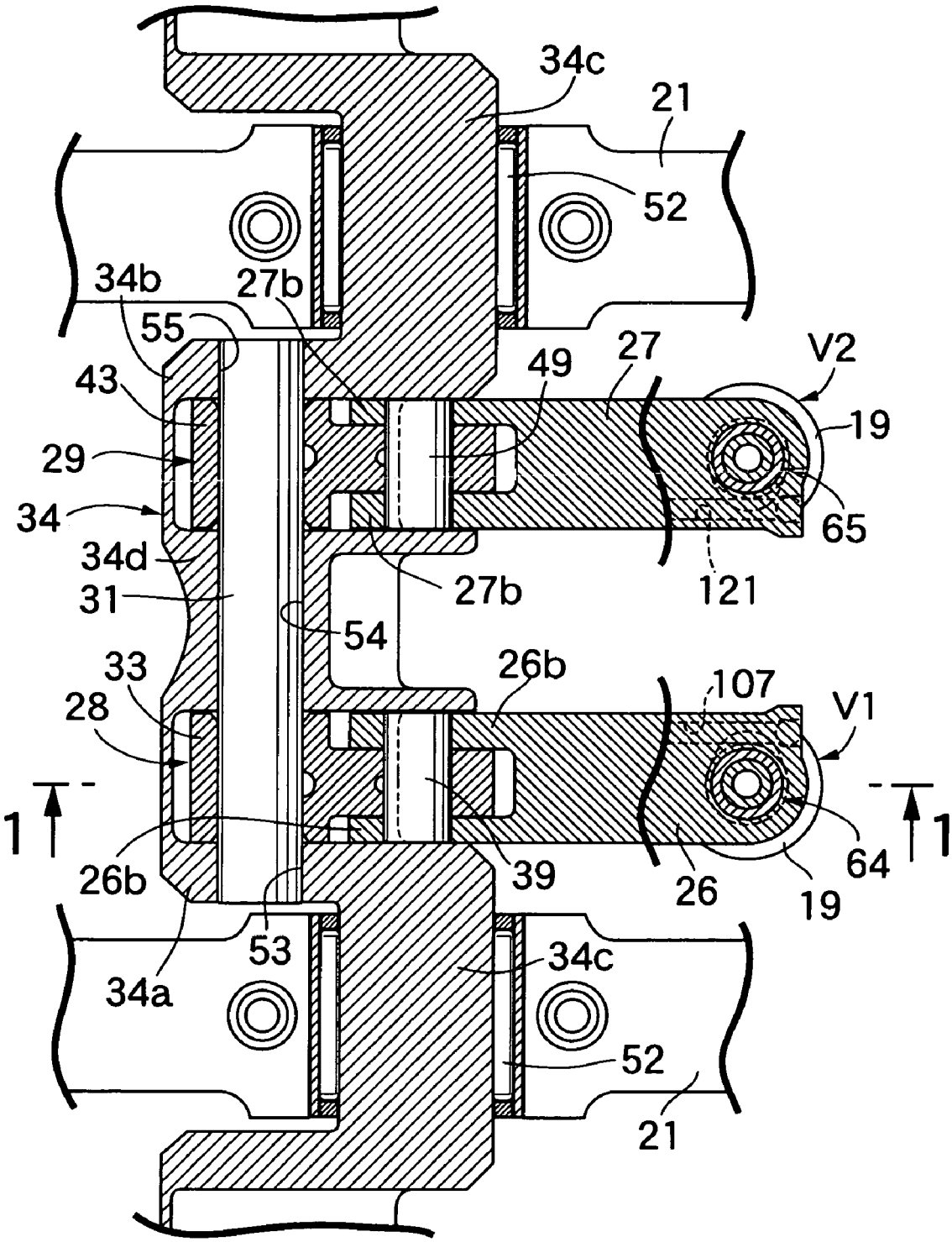
FIG. 2 is a sectional view taken along a line 2-2 in FIG. 1.
Figure 3:
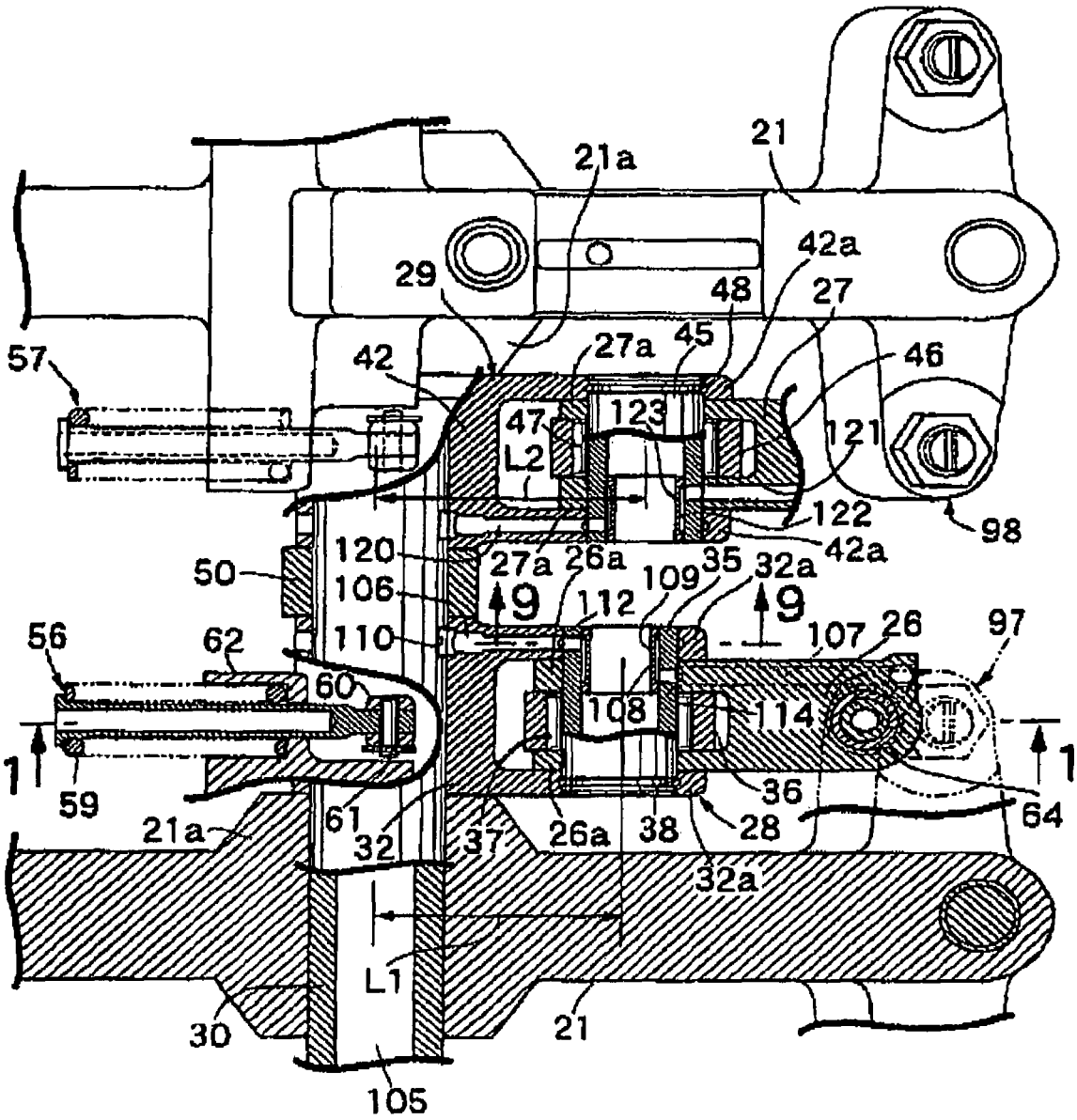
FIG. 3 is a sectional view taken along a line 3-3 in FIG. 1.

Referring first to FIGS. 1 to 3, a pair of first and second intake valves V1 and V2 for every cylinder are openably and closably disposed in a cylinder head 16 included in an engine body 15 of a multi-cylinder internal combustion engine. Valve springs 20 each adapted to bias each intake valve are mounted between the cylinder head 16 and valve seats 19 provided at upper ends of stems 18 included in the intake valves V1 and V2.

The cylinder head 16 is integrally provided with cam holders 21 disposed on opposite sides of each cylinder, and a camshaft 23 is rotatably carried between the cam holders 21 and holder caps 22 fastened to the cam holders 21 respectively. The camshaft 23 is provided with first and second valve-operating cams 24 and 25 individually corresponding to the first and second intake valves V1 and V2.

A first rocker arm 26 adapted to be swung following the first valve-operating cam 24 is operatively connected to the first intake valve V1, so that the lift amount of the first intake valve V1 can be varied in a stepless manner by a first lift-varying mechanism 28. A second rocker arm 27 adapted to be swung following the second valve-operating cam 25 is operatively connected to the second intake valve V2, so that the lift amount of the second intake valve V2 can be varied in a stepless manner by a second lift-varying mechanism 29.

The first rocker arm 26 operatively connected at one end thereof to the first intake valve V1 has a pair of upper connecting walls 26*a*, 26*a* provided at its upper portion closer to the other end in an opposed relation to each other at a distance, so that they form a substantially U-shape opening toward a side opposite from the first intake valve V1, and a pair of lower connecting walls 26*b*, 26*b* provided at its lower portion closer to the other end in an opposed relation to each other at a distance, so that they form a substantially U-shape opening toward the side opposite from the first intake valve V1.

The first lift-varying mechanism 28 comprises a first upper link arm 32 which is turnably connected at one end thereof to the upper portion closer to the other end of the first rocker arm 26 and turnably carried at the other end thereof at a fixed position on the engine body 15 through a stationary support shaft 30, and a first lower link arm 33 which is turnably connected at one end thereof to the lower portion closer to the other end of the first rocker arm 26 and turnably carried at the other end thereof by a movable support shaft 31 to constitute a four-joint link together with the first rocker arm 26 and the first upper link arm 32. The movable support shaft 31 has an axis parallel to the stationary support shaft 30 and is connected to a control shaft 34 which is driven to turn by an actuator which is not shown.

One end of the first upper link arm 32 is formed into a substantially U-shape to have a pair of connecting walls 32*a*, 32*a* which sandwich the upper connecting walls 26*a* of the first rocker arm 26 from opposite sides. Both of the connecting walls 32*a* are turnably connected to the upper connecting walls 26*a* through an upper connecting shaft 35. Moreover, a roller 36 serving as a cam abutment portion abutting against the-first valve-operating cam 24 is disposed between the pair of upper connecting walls 26*a* of the first rocker arm 26. The roller 36 is supported on both of the upper support walls 26*a* through the hollow cylindrical upper connecting shaft 35 and a needle bearing 37. The upper connecting shaft 35 is inserted through both of the connecting walls 32*a* of the first upper link arm 32 and both of the upper connecting walls 26*a* of the first rocker arm 26, so that the withdrawal of the upper connecting shaft 35 from both of the connecting walls 32*a* of the first upper link arm 32 and both the upper connecting walls 26*a* of the first rocker arm 26 is inhibited by the engagement of a retaining ring 38 mounted to an outer surface of the upper connecting shaft 35 with an inner surface of one of the connecting walls 32a included in the first upper link arm 32.

The stationary support shaft 30 which turnably supports the other end of the first upper link arm 32 is supported on the cam holders 21 integrally provided in the cylinder head 16 with its axis parallel to the camshaft 23. One end of the first lower link arm 33 disposed below the first upper link arm 32 is disposed so as to be sandwiched between the lower connecting walls 26*b* of the first rocker arm 26 and is turnably connected to the lower connecting walls through a lower connecting shaft 39.

The second rocker arm 27 operatively connected at one end thereof to the second intake valve V2 has a pair of upper connecting walls 27*a*, 27*a* provided at its upper portion closer to the other end thereof in an opposed relation to each other at a distance, so that they form a substantially U-shaped opening toward a side opposite the second intake valve V2, and a pair of lower connecting walls 27*b*, 27*b* provided at its lower portion closer to the other end in an opposed relation to each other at a distance, so that they form a substantially U-shaped opening toward the side opposite the second intake valve V2.

The second lift-varying mechanism 29 comprises a second upper link arm 42 which is turnably connected at one end thereof to the upper portion closer to the other end of the second rocker arm 27 and is turnably carried at the other end thereof through the stationary support shaft 30 common to the first lift-varying mechanism 28, and a second lower link arm 43 which is turnably connected at one end thereof to the lower portion closer to the other end of the second rocker arm 27 and is turnably carried at the other end thereof by the movable support shaft 31 common to the first lift-varying mechanism 28.

One end of the second upper link arm 42 is formed into a substantially U-shape to have a pair of connecting walls 42*a*, 42*a* which sandwich the upper connecting walls 27*a* of the second rocker arm 27 from opposite sides. Both of the connecting walls 42*a* are turnably connected to the upper connecting walls 27*a* through an upper connecting shaft 45. Moreover, a roller 46 serving as a cam abutment portion abutting against the second valve-operating cam 25 is disposed between the pair of upper connecting walls 27*a* of the second rocker arm 27. The roller 36 is supported on both of the upper support walls 27*a* through the hollow cylindrical upper connecting shaft 45 and a needle bearing 47. The upper connecting shaft 45 is inserted through both of the connecting walls 42*a* of the second upper link arm 42 and both of the upper connecting walls 27*a* of the second rocker arm 27, so that the withdrawal of the upper connecting shaft 45 from both the connecting walls 42*a* of the second upper link arm 42 and both the upper connecting walls 27*a* of the second rocker arm 27 is inhibited by the engagement of a retaining ring 48 mounted to an outer surface of the upper connecting shaft 45 with an inner surface of one of the connecting walls 42*a* included in the second upper link arm 42.

One end of the second lower link arm 43 disposed below the second upper link arm 42 is disposed so as to be sandwiched between the lower connecting walls 27*b* of the second rocker arm 27 and is turnably connected to the lower connecting walls 27*b* through a lower connecting shaft 49.

The other end of the first upper link arm 32 in the first lift-varying mechanism 28 and the other end of the second upper link arm 42 in the second lift-varying mechanism 29 are disposed between the pair of cam holders 21 with a ring-shaped spacer 50 surrounding the stationary support shaft 30 being interposed therebetween. Boss portions 21*a* are integrally and projectingly provided on the cam holders 21 to come into sliding contact with outer sides of the other ends of the first and second upper link arms 32 and 42.

Figure 4:
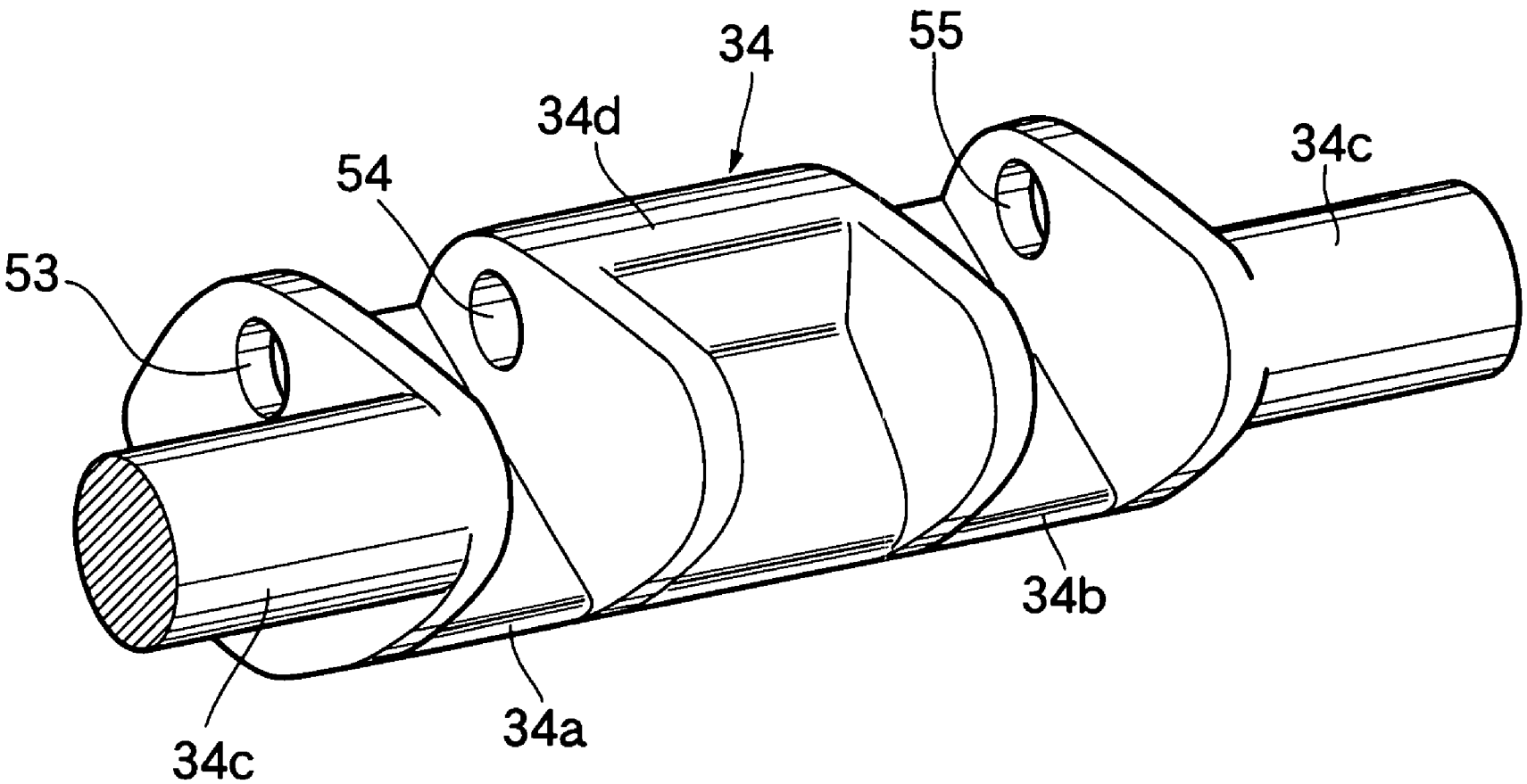
FIG. 4 is a perspective view of a control shaft.

Referring also to FIG. 4, the single control shaft 34 is carried in the engine body commonly to a plurality of cylinders arranged in one row, and comprises, for every cylinder, a first support portion 34*a* formed into a substantially U-shaped opening toward the first rocker arm 26 in such a manner that they sandwich the lower portion of the first rocker arm 26 closer to the other end and the first lower link arm 33 from opposite sides, a second support portion 34*b* formed into a substantially U-shaped opening toward the second rocker arm 27 in such a manner that they sandwich the lower portion of the second rocker arm 27 closer to the other end and the second lower link arm 43 from opposite sides, journal portions 34*c*, 34*c* connected at right angles to outer surfaces of the first and second support portions 34*a* and 34*b* on opening sides, and a connecting portion 34*d* interconnecting closed portions of the first and second support portions 34*a* and 34*b*.

Each of the journal portions 34*c* of the control shaft 34 is turnably carried between each of the cam holders 21 mounted in the cylinder head 16 of the engine body 15 and a lower holder 51 coupled from below to the cam holders 21, and roller bearings 52 are interposed between the cam holders 21 and the lower holder 51.

The lower connecting shafts 39 and 49, each of which connect one end of the first and second lower link arms 33 and 43 disposed within the first and second support portions 34*a* and 34*b* to the first and second rocker arms 26 and 27, respectively, are inserted through one ends of the first and second lower link arms 33 and 43 as well as through the lower portions of the first and second rocker arms 26 and 27 closer to the other ends in such a manner that their axial movements are inhibited by the opposite sides of the first and second lower link arms 33 and 43.

Further, support bores 53, 54 and 55 parallel to the journal portions 43*c* are coaxially provided in the first support portion 43*a*, the connecting portion 43*d* and the second support portion 43*b*, and the movable support shaft 31, on which the other ends of the first and second lower link arms 33 and 43 are turnably carried, is inserted through the support bores 53 to 55. Thus, the movable support shaft 31 is moved between a position shown by a solid line in FIG. 1 and a position shown by a dashed line in FIG. 1 in a plane perpendicular to the axis of the camshaft 23 by turning of the control shaft 34 about axes of the journal portions 34*c*.

When the movable support shaft 31 is in the position shown by the solid line in FIG. 1 in the first and second lift-varying mechanisms 28 and 29, the four-joint link connecting the upper connecting shafts 35 and 45, the lower connecting shafts 39 and 49 and the movable support shaft 31 is deformed when the rollers 36 and 46 are urged by the first and second valve-operating cams 24 and 25, whereby the first and second rocker arms 26 and 27 are swung downwards to open the first and second intake valves V1 and V2 with a lower lift. When the movable support shaft 31 is raised to the position shown by the dashed line in FIG. 1, the first and second intake valves V1 and V2 are opened with a higher lift.

Figure 5A:
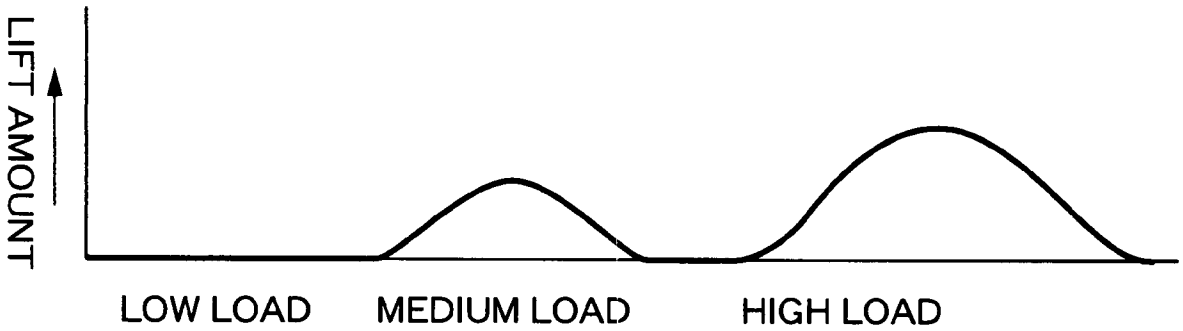
FIGS. 5A and 5B are diagrams showing lift characteristics of a pair of intake valves.
Figure 5B:
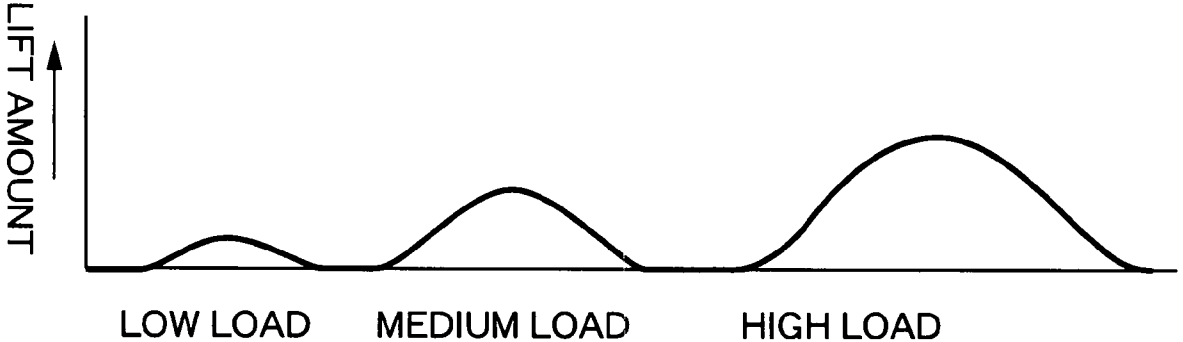

Moreover, the lift characteristics of the first intake valve V1 and the second intake valve V2 in accordance with a loading of the engine are established as shown in FIG. 5. In order to ensure that the lift characteristics of the first and second intake valves V1 and V2 are identical to each other in a higher-load operating region of the engine, and that one of the first and second intake valves V1 and V2 is brought to rest in a closed state in a lower-load operating region of the engine, the first and second lift-varying mechanisms 28 and 29 are constructed with mutually different geometries of points of connection of the first upper and lower link arms 32 and 33 as well as the second upper and lower link arms 42 and 43 to the first and second rocker arms 26 and 27, and cam profiles of the first and second valve-operating cams 24 and 25 are established to be different from each other. In this embodiment, to ensure that the first intake valve V1 is brought to rest in the closed state in the lower-load operating region of the engine, a distance L1 between the stationary support shaft 30 and the upper connecting shaft 35 in the first upper link arm 32 is set to be shorter than a distance L2 between the stationary support shaft 30 and the upper connecting shaft 45 in the second upper link arm 42.

Because the geometries of the first and second lift-varying mechanisms 28 and 29 are different from each other, the first and second cams 24 and 25 are mounted in circumferentially offset positions on the camshaft 23 in order to ensure that the timings for closing the first and second intake valves V1 and V2 are matched with each other.

The first intake valve V1 is biased in a closing direction by the valve spring 20, and when the first intake valve V1 biased in the closing direction is being driven in an opening direction by the first rocker arm 26, the roller 36 of the first rocker arm 26 is in contact with the first valve-operating cam 24 under the action of the valve spring 20. In the closed state of the first intake valve V1, however, the spring force of the valve spring 20 cannot be applied to the first rocker arm 26 and hence, there is a possibility that the roller 36 is separated from the first rocker arm 26, resulting in a reduction in accuracy of control of the valve lift amount during slight opening of the first intake valve V1. Therefore, the first rocker arm 26 is biased by a resilient biasing means 56 different from the valve spring 20 in a direction of abutment of the roller 36 against the first valve-operating cam 24.

The resilient biasing means 56 comprises a pull rod 58 connected at one end thereof to the first rocker arm 26, and a compression coil spring 59 interposed between the other end of the pull rod 58 and the engine body 15 to pull the pull rod 58 to bias the first rocker arm 26 in a direction of abutment of the roller 36 against the first cam 24.

In this embodiment, the first upper link arm 32 connected at one end thereof to the first rocker arm 26 through the upper connecting shaft 35 is integrally provided at the other end thereof with a bracket 60 extending upwards, and one end of the pull rod 58 is connected to the bracket 60 through a connecting pin 61. An intermediate portion of the pull rod 58 is slidably fitted into a support arm 62 integrally provided on the cam holders 21 integrally included in the cylinder head 16 of the engine body 15. The compression coil spring 59 surrounding the pull rod 58 is mounted under compression between the support arm 62 and a collar 58*a* which is provided at the other end of the pull rod 58 to overhang radially outwards.

A resilient biasing means 57 constructed in a manner similar to the resilient biasing means 56 is also mounted between the second upper link arm 42 connected at one end thereof to the second rocker arm 27 and the support arm 62, so that the second rocker arm 27 is biased by the resilient biasing means 57 different from the valve spring 20 in a direction of abutment of the roller 46 against the second valve-operating cam 25.

Figure 6:
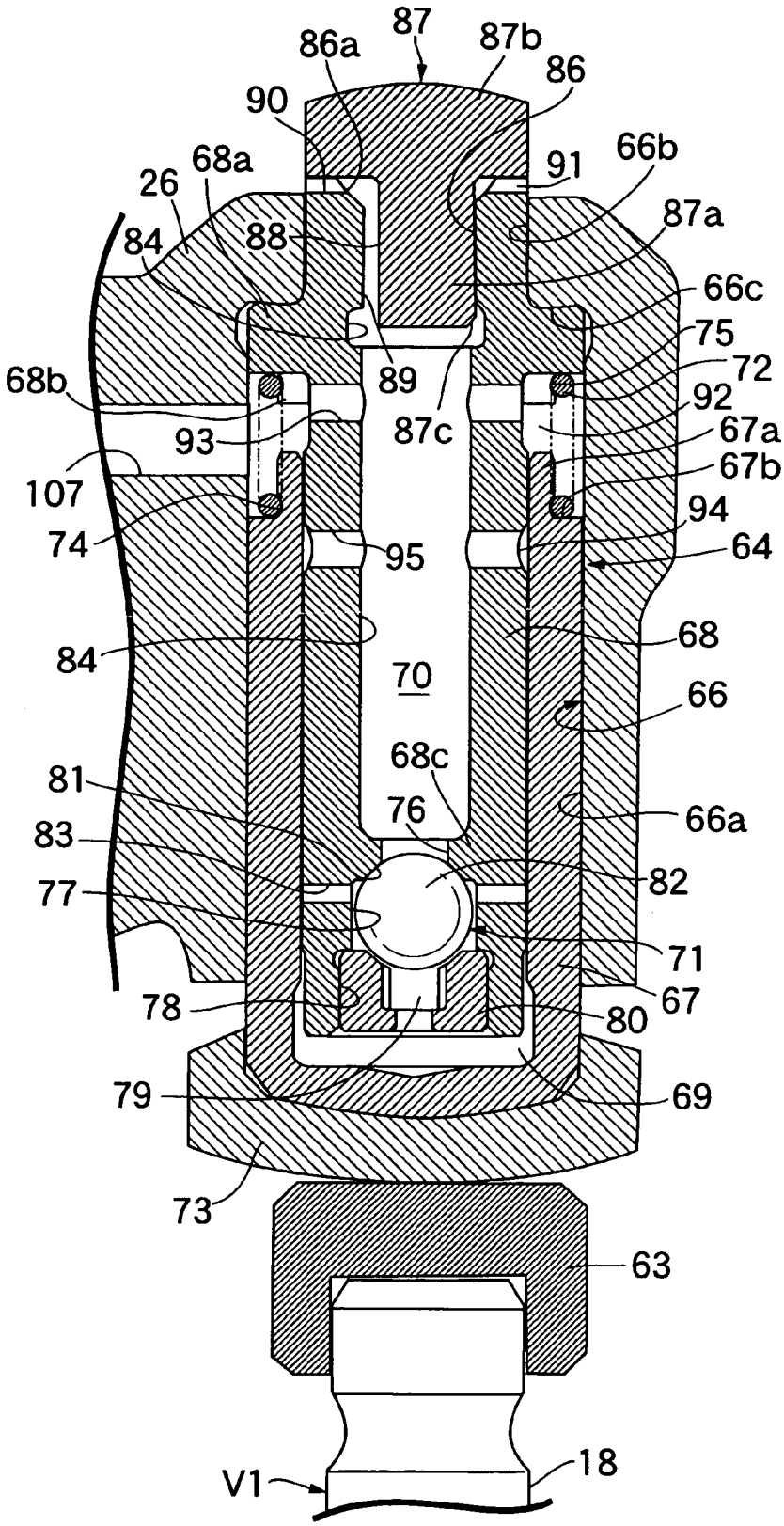
FIG. 6 is an enlarged vertical sectional view of an area in the vicinity of a hydraulic tappet.

Referring to FIG. 6, the first rocker arm 26 is provided at one end thereof with a mounting bore 66 for mounting a hydraulic tappet 64 adapted to abut against a cap 63 mounted at an upper end of the stem 18 of the first intake valve V1. The mounting bore 66 comprises a larger-diameter bore portion 66*a* which opens at its lower end to a lower portion of one end of the first rocker arm 26, and a smaller-diameter bore portion 66*b* which is formed to have a diameter smaller than that of the larger-diameter bore portion 66*a* and which opens at its upper end to an upper portion of one end of the first rocker arm 26. The larger-diameter bore portion 66*a* and the smaller-diameter bore portion 66*b* are coaxially connected to each other through an annular step 66*c* facing downwards.

The hydraulic tappet 64 comprises: a bottomed cylindrical body 67 slidably mounted in the larger-diameter bore portion 66*a* of the mounting bore 66 with its closed end disposed on the side of the first intake valve V1; a plunger 68 slidably mounted in the body 67; a check valve 71 mounted at one end of the plunger 68 and interposed between a high-pressure chamber 69 formed between the closed end of the body 67 and one end of the plunger 68 and an oil chamber 70 formed within the plunger 68; and a return spring 72 mounted between the body 67 and the plunger 68 to exhibit a spring force for biasing the plunger 68 in a direction to increase the volume of the high-pressure chamber 69. A tip 73 is mounted at the closed end of the body 67 to abut against the cap 63 at the upper end of the first intake valve V1.

The return spring 72 of a coil shape surrounding the plunger 68 is mounted between the body 67 and the plunger 68 outside the body 67. A one end-side inner periphery-restricting small-diameter cylindrical tube portion 67*a* is coaxially and integrally provided at the other end of the body 67 to form an annular step 67*b* receiving one end of the return spring 72, so that it is inserted into one end of the return spring 72. The plunger 68 basically formed into a cylindrical shape is coaxially and integrally provided with a receiving collar 68*a* overhanging radially outwards so as to be opposed to the step 67*b*, and a cylindrical other end-side inner periphery-restricting tube portion 68*b* connected to a base end of the receiving collar 68*a* in such a manner that it is inserted into the other end of the return spring 72. The other end of the return spring 72 is in abutment against the receiving collar 68*a*.

An annular locking groove 74 is provided in an outer surface of a base end of the one end-side inner periphery-restricting tube portion 67*a*, while an annular locking groove 75 is provided in an outer surface of the other end-side inner periphery-restricting tube portion 68*b*, and opposite ends of the return spring 72 are locked in the locking grooves 74 and 75. Namely, the opposite ends of the return spring 72 are locked to the body 67 and the plunger 68.

An inward-facing collar 68*c* is integrally provided on an inner surface of the plunger 68 at a location closer to one end, i.e., a lower end of the plunger 68 to overhang radially inwards in such a manner that a valve bore 76 is formed by its inner periphery. Coaxially provided in the plunger 68 below the inward-facing collar 68*c* are a valve chest-forming bore 77 formed to have a diameter larger than that of the valve bore 76, and a first press-fit bore 78 formed to have a diameter larger than that of the valve chest-forming bore 77, so that the valve chest-forming bore 77 is disposed at a location closer to the inward-facing collar 68*c*.

The check valve 71 comprises: a cage 80 mounted to one end of the plunger 68 to form a valve chest 79 between the cage 80 and the inward-facing collar 68*c* of the plunger 68; a tapered valve seat 81 provided on an inner periphery of the inward-facing collar 68*c* at a location closer to one end to face the valve chest 79 so that it faces the valve chest 79 and the valve bore 76 opens into a central portion of the valve seat 81; and a spherical valve member 82 accommodated in the valve chest 79 so that it can be seated on the valve seat 81.

The cage 80 is formed into a short cylindrical shape by chipping and press-fitted into the first press-fit bore 78 in the plunger 68. The cage 80 is press-fitted into the first press-fit bore 78, so that a very small clearance, for example, of 0.15 mm is left between the cage 80 and the valve member 82 upon seating of the valve member 82 on the valve seat 81.

Moreover, a plurality of air vent bores 83 are provided by boring in the plunger at locations corresponding to portions of the valve chest-forming bore 77 closer to the inward-facing collar 68*c* in such a manner that their inner ends lead to the valve chest 79 and their outer ends open into the outer periphery of the plunger 68.

Provided in the plunger 68 above the inward-facing collar 68*c* are an oil chamber-forming bore 84 formed to have a diameter greater than that of the valve bore 76 to form an oil chamber 70 and coaxially connected at one end to the valve bore 76, and a second press-fit bore 86 coaxially connected to the other end of the oil chamber-forming bore 84 through an annular recess 85. A cap 87 is fixed to the other end of the plunger 68 to close an end of the oil chamber 70 on a side opposite the high-pressure chamber 69.

Figure 7:
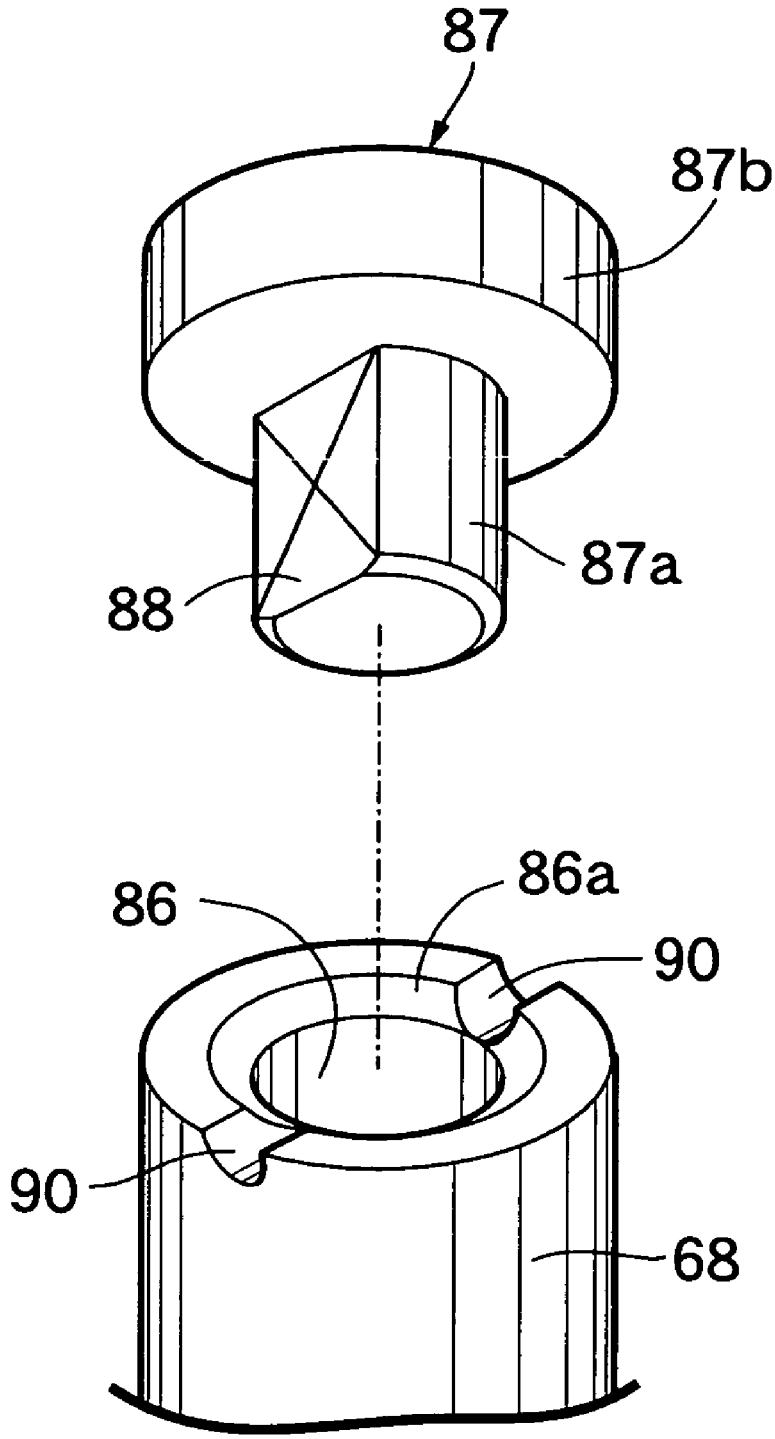
FIG. 7 is an exploded view of a portion of the hydraulic tappet.

Referring also to FIG. 7, a tapered chamfer portion 86*a* having a diameter increasing in an axially outward direction is formed at an axially outer end of the second press-fit bore 86. On the other hand, the cap 87 is integrally provided with a shaft portion 87*a* extending coaxially with y the plunger 68, and a flange portion 87*b* coaxially connected to the shaft portion 87*a* so that the cap 87 is fixed to the other end of the plunger 68, by press-fitting the shaft portion 87*a* into the second press-fit bore 86 until the flange portion 87*b* is brought into opposed abutment against the other end face of the plunger 68. Moreover, a tapered chamfer portion 87*c* is formed on an outer periphery of a tip end of the shaft portion 87*a* in order to smoothly perform the press-fitting of the shaft portion 87*a* into the second press-fit bore 86.

A flat notch 88 is provided at least at one place in an outer periphery of the shaft portion 87*a* to extend axially in such a manner that a first air vent passage 89 leading to the oil chamber 70 is formed between the notch 88 and an inner surface of the second press-fit bore 86. Grooves 91, 91 are provided in the other end face of the plunger 68, for example, at two places on one diametrical line of the plunger 68, with their inner ends opening into an inner surface of the chamfer portion 86*a*, so as to extend in a radial direction of the plunger 68 in such a manner that a second air vent passage 90 is formed between the grooves 91, 91 and the flange portion 87*b*.

Such a hydraulic tappet 64 is mounted at one end of the first rocker arm 26 in such a manner that the upper portion of the plunger 68 is fitted into the smaller-diameter bore portion 66*b* of the mounting bore 66 with the receiving collar 68*a* opposed to the step 66*c*, and the body 67 is slidably fitted into the larger-diameter bore portion 66*a*. An annular oil chamber 92 is formed in the mounting bore 66 between the other end of the body 67 and the receiving collar 68*a* of the plunger 68, and the return spring 72 is accommodated in the annular oil chamber 92.

A plurality of communication bores 93 are provided in a sidewall of the plunger 68 at a portion where the other end-side inner periphery-restricting tube portion 68*b* is provided to bring the oil chamber 70 within the plunger 68 into communication with the annular oil chamber 92. Portions of the other end-side inner periphery-restricting tube portion 68*b* corresponding to the communication bores 93 are cut out into a slit shape.

An annular recess 94 for accumulation of an oil for lubricating a section between the body 67 and the plunger 68 is provided in an outer surface of an intermediate portion of the plunger 68 at a portion slidably fitted into the body 67. A plurality of lubricating bore 95 for guiding the oil in the oil chamber 70 to the annular recess 94 is provided in the plunger 68.

In such a hydraulic tappet 64, when the first intake valve V1 is closed, the body 67 is biased by the spring force of the return spring 72 as well as the hydraulic pressure force provided by the hydraulic pressure in the annular oil chamber 70 so as to bring the tip 73 mounted at the closed end of the body 67 into abutment against the cap 63 at the upper end of the first intake valve V1, whereby the clearance between the first rocker arm 26 and the first intake valve V1 becomes "0". In addition, when the first intake valve V1 is closed, the body 67 is biased in a direction to decrease the volume of the high-pressure chamber 69 by a reaction force applied from the first intake valve V1 to the body 67, thereby closing the check valve 71 to confine the oil in the high-pressure chamber 69, whereby the axial relative movement of the body 67 relative to the plunger 68 is inhibited. Thus, a valve-opening driving force transmitted from the first rocker arm 26 is reliably transmitted to the first intake valve V1.

Referring again to FIG. 1, the cam holders 21 integrally included in the cylinder head 16 of the engine body 15 are provided with a lift amount-adjusting mechanism 97 for adjusting the lift amount of the first intake valve V1, and the hydraulic tappet 64 is interposed between the first intake valve V1 and the lift amount-adjusting mechanism 97.

The lift amount-adjusting mechanism 97 comprises: a screw retaining section 99 mounted on the cam holders 21 to lie above the one end of the first rocker arm 26; an adjusting screw 100 which is threadedly fitted in the screw retaining section 99 so as to advance and retract with its tip end being in abutment against the flange portion 87*b* of the cap 87 in the hydraulic tappet 64; and a locking nut 101 threadedly fitted over the adjusting screw 100. The locking nut 101 is put into abutment engagement with the screw retaining section 99 to retain the advanced or retracted position of the adjusting screw 100.

Such a lift amount-adjusting mechanism 97 enables the lift amount of the first intake valve V1 to be adjusted by loosening the locking nut 101 to adjust the advanced or retracted position of the adjusting screw 100, thereby changing the distance between the first rocker arm 26 and the step 66*c*.

A hydraulic tappet 65 is mounted at one end of the second rocker 27 operatively connected to the second intake valve V2 as in the case of the first rocker arm 26 so as to abut against the second intake valve V2. The cam holders 21 are provided with a lift amount-adjusting mechanism 98 for adjusting the lift amount of the second intake valve V2, and the hydraulic tappet 65 is also interposed between the second intake valve V2 and the lift amount-adjusting mechanism 98.

The stationary support shaft 30 is formed into a hollow cylindrical shape so as to coaxially form an oil passage 105 for guiding an oil from an oil pump (not shown). A first passage 106 leading to the oil passage 105 is provided in the first upper link arm 32, and a second passage 107 leading to the hydraulic tappet 64 is provided in the first rocker arm 26. A passage-forming member 109 is inserted into and fixed in the upper connecting shaft 35 to form a communication passage 108 between the passage-forming member 109 and an inner periphery of the upper connecting shaft 35 in order to interconnect the first and second passages 106 and 107.

The first passage 106 is provided in the first upper link arm 32 to extend in one straight line in a plane perpendicular to the axis of the stationary support shaft 30 at a location closer to a side opposite from a side of sliding contact with the boss portions 21*a* of the cam holders 21. The stationary support shaft 30 is provided with a communication bore 110 which is adapted to permit the oil passage 105 in the stationary support shaft 30 to communicate with the first passage 106, irrespective of the turning of the first upper link arm 32 about the axis of the stationary support shaft 30. The second passage 107 is provided in the first rocker arm 26 to pass rectilinearly within inner one 26*a* of the pair of upper connecting walls 26*a* included in the first rocker arm 26.

Figure 8:
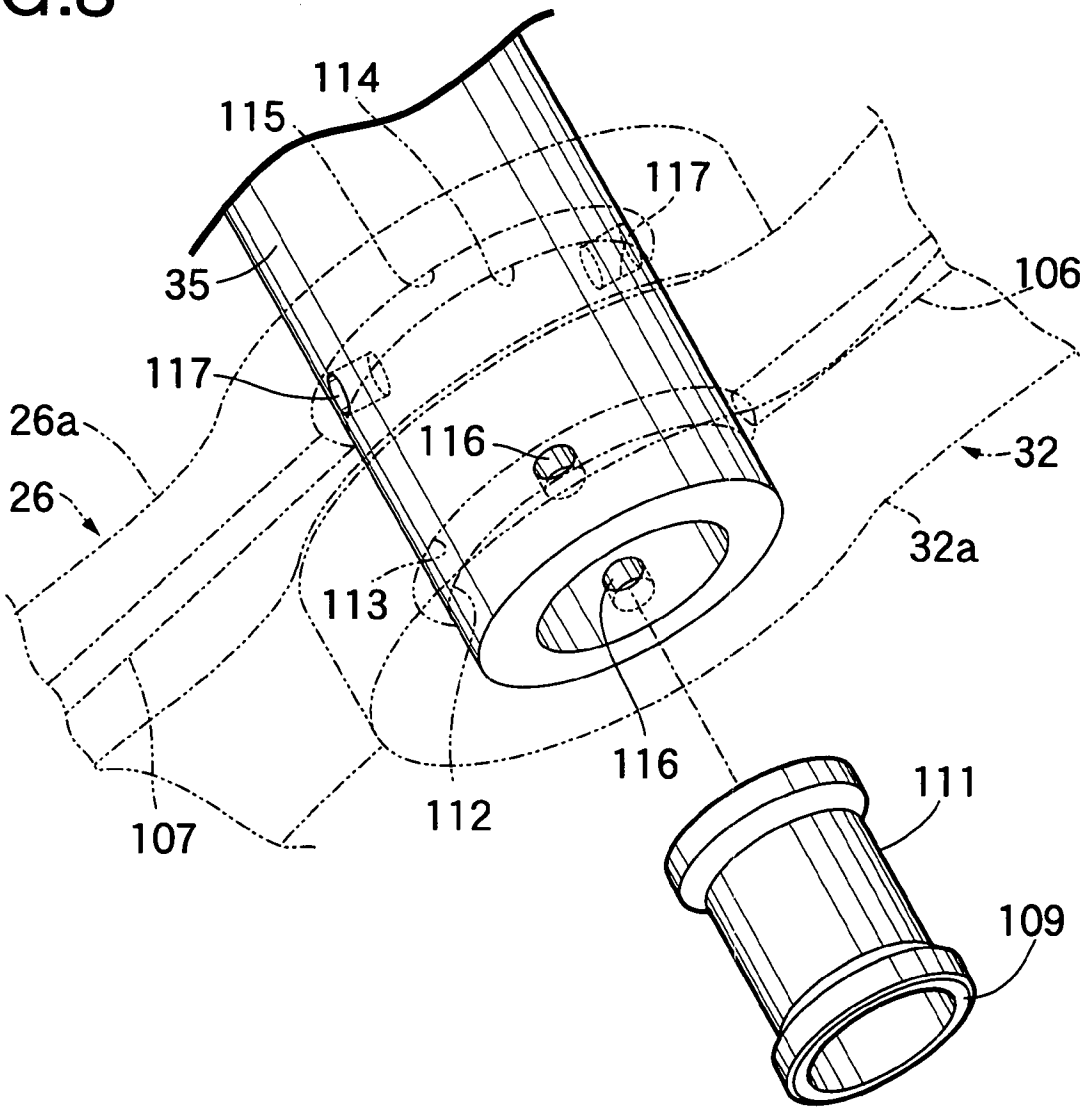
FIG. 8 is an exploded perspective view of an upper connecting shaft and a passage-forming member.
Figure 9:
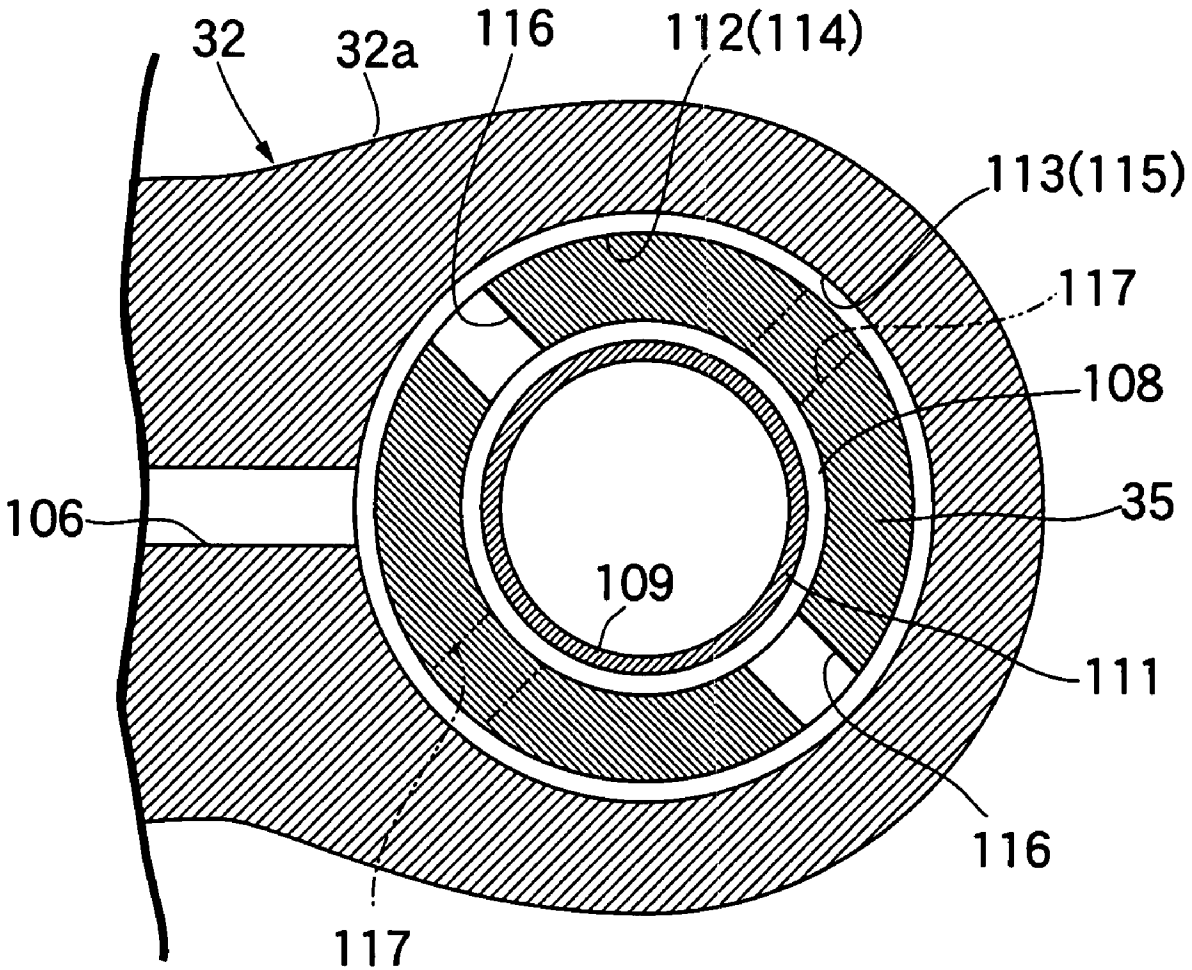
FIG. 9 is an enlarged sectional view taken along a line 9-9 in FIG. 3.

Referring to FIGS. 8 and 9, the passage-forming member 109 is formed into a hollow cylindrical shape from a metal or a synthetic resin, and an annular recess 111 is provided around an outer periphery of the passage-forming member 109 to form an annular communication passage 108 between the inner surface of the upper connecting shaft 35 and the outer periphery of the passage-forming member 109.

A first annular groove 113 leading to the first passage 106 is provided in an inner periphery of a first fitting bore 112 provided in the connecting wall 32*a* of the first upper link arm 32 in such a manner that the upper connecting shaft 35 is fitted into the first fitting bore 112. A second annular groove 115 leading to the second passage 107 is provided in an inner periphery of a second fitting bore 114 provided in the upper connecting wall 26*a* of the first rocker arm 26 in such a manner that the upper connecting shaft 35 is fitted into the second fitting bore 114. A pair of first communication bores 116, 116 connecting the first annular groove 113 and the communication passage 108 to each other and a pair of second communication bores 117, 117 connecting the second annular groove 115 and the communication passage 108 to each other are provided by boring in the upper connecting shaft 35 in such a manner they are disposed on diametrical lines which do not overlap each other, e.g., on diametrical lines perpendicular to each other in this embodiment.

In the case of the second lift-varying mechanism 29, the oil passage 105 in the stationary support shaft 30 and the hydraulic tappet 65 are connected to each other, as in the case of the first lift-varying mechanism 28, through a first passage 120 provided in the second upper link arm 42 to lead to the oil passage 105, a second passage 121 directed to the second rocker arm 27 to lead to the hydraulic tappet 65, and a communication passage 122 formed within the upper connecting shaft 45 to connect the first and second passages 120 and 121 to each other. The communication passage 122 is formed between an inner periphery of the upper connecting shaft 45 and an outer periphery of a passage-forming member 123 inserted into and fixed in the upper connecting shaft 45.

Moreover, a structure of connection between the communication passage 122 and the first and second passages 120 and 121 is constructed similarly to a structure of connection between the communication passage 108 and the first and second passages 106 and 107 in the first lift-varying mechanism 28.

To adjust the lift amount for the first and second intake valves V1 and V2 in each of the cylinders, a compression pressure within the combustion chamber is measured during cranking by a stator motor (not shown) or the like in a non-burned state, and the lift amount for the first and second intake valves V1 and V2 is adjusted based on a measured value.

Figure 10:
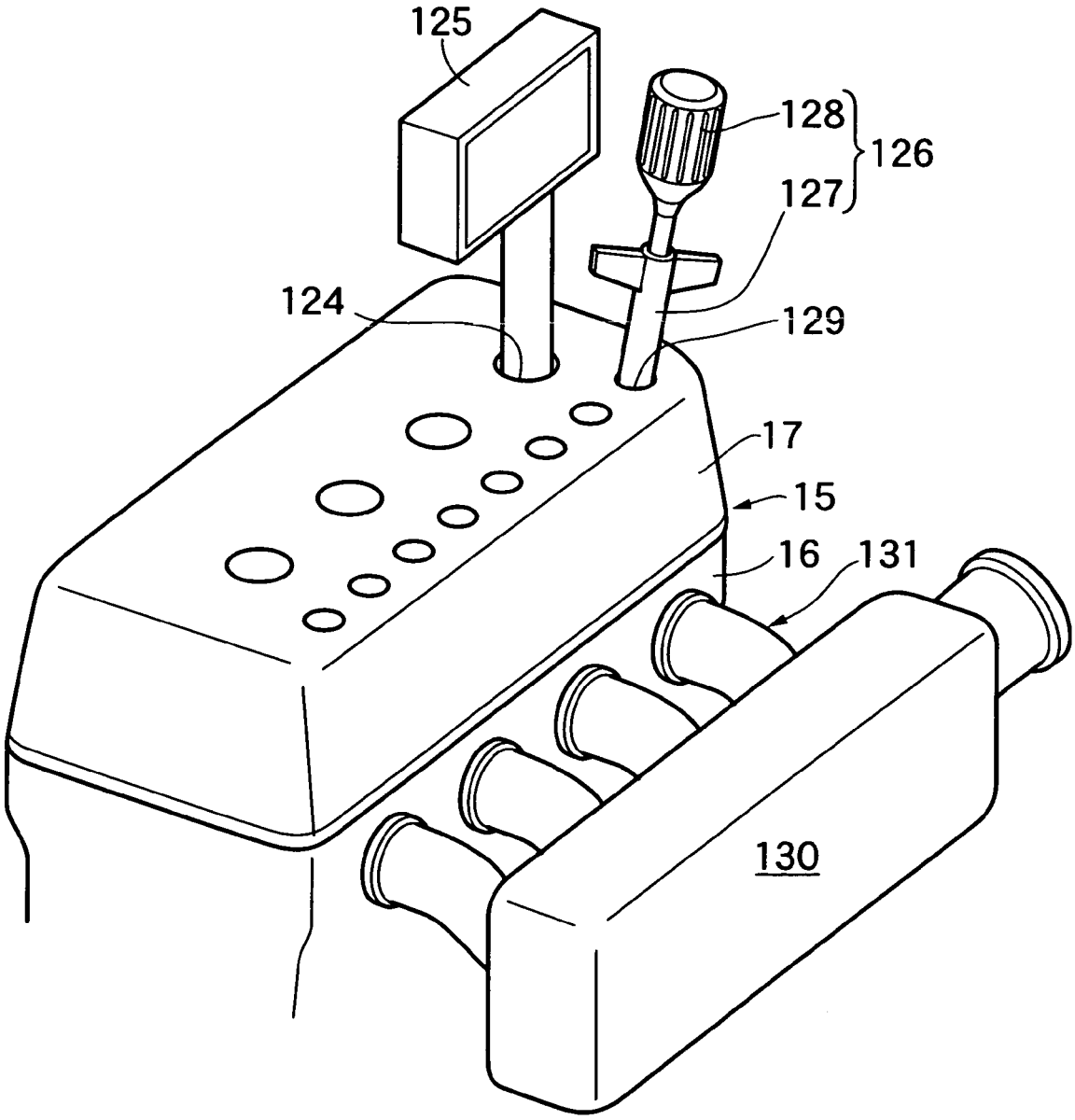
FIG. 10 is a perspective view showing a state during adjustment of lift amounts of the intake valves in a simplified manner.

Specifically, in order to adjust the lift amount in the case of a 4-cylinder in-line multi-cylinder internal combustion engine in which an intake chamber 130 is connected to the cylinder head 16 through an intake manifold 131, as shown in FIG. 10, operating bores 129 individually corresponding to the lift amount-adjusting mechanisms 98 and 98 in each of cylinders are previously provided in a sealable manner in the head cover 17 coupled to the cylinder head 16 to constitute a portion of the engine body 15, and a pressure gage 125 for measuring a compression pressure in the combustion chamber is inserted into one of plug-insertion bores 124 provided in the head cover 17.

The adjustment by the lift amount-adjusting mechanism 97, 98 is carried out by inserting an adjusting tool 126 into the opened operating bore 129. The adjusting tool 126 is of a conventionally well-known type comprising a screw operating member 128 capable of rotating the adjusting screw 100 and mounted to a nut operating member 127 capable of the locking nut 101 in the lift amount-adjusting mechanism 97, 98.

To adjust the lift amount for the first and second intake valves V1 and V2 in one cylinder, at first, the intake valves V1 and V2 are previously set so that the lift amount for one of them is to be adjusted, while the lift amount for the other intake valve is zero. The lift amount for one of the intake valves V1 and V2 is adjusted so that a compression pressure provided upon the operation of one of the intake valves V1 and V2 is equal to a defined value, and thereafter, the lift amount for the other intake valve V1 or V2 is adjusted so that a compression pressure provided upon the operation of both the intake valves V1 and V2 is equal to a defined value.

The operation of this embodiment will be described below. The pair of lift-varying mechanisms 28 and 29 are disposed in individual correspondence to the first and second intake valves V1 and V2 which are of one pair per cylinder. In order to ensure that the lift characteristics of the first and second intake valves V1 and V2 are identical to each other in the higher-load operating region of the engine, and that one of the first and second intake valves V1 and V2 is at rest in the closed state in the lower-load operating region of the engine, the first and second lift-varying mechanisms 28 and 29 are constructed so that the geometry of points of connection of the first upper link arm 32 and the first lower link arm 33 to the first rocker arm 26 as well as the geometry of points of connection of the second upper link arm 42 and the second lower link arm 43 to the second rocker arm 27 are different from each other, and cam profiles of the first and second valve-operating cams 24 and 25 are established to be different from each other in individual correspondence to the first and second rocker arms 26 and 27.

Therefore, it is possible to achieve an enhancement in output characteristic in the high-load operating region by ensuring that the lift characteristics of the first and second intake valves V1 and V2 are identical to each other in the higher-load operating region of the engine. In addition, it is possible to generate swirl to achieve an increase in combustion efficiency and to achieve a reduction in fuel consumption and an enhancement in exhausting performance by ensuring that the first intake valve V1 is brought to rest in the closed state in the low-load operating region of the engine. Moreover, in the low-load operating region, the lift amount of the second intake valve V2 is large, as compared with the case of an arrangement such that the first and second intake valves V1 and V2 are opened at the same characteristic and hence, it is easy to control and adjust the lift amount of the second intake valve V2 in the low-load operating region in which the lift amount is smaller.

In addition, the first and second rocker arms 26 and 27 are biased in the direction of abutment of the rollers 36 and 46 against the first and second valve-operating cams 24 and 25 by the resilient biasing means 56 and 57 different from the valve springs 20 for biasing the first and second intake valves V1 and V2 in the closing direction. Each of the resilient biasing means 56 and 57 comprises the pull rod 58 connected at one end thereof to corresponding one of the first and second rocker arms 26 and 27, and the compression coil spring 59 interposed between the other end of the pull rod 58 and the engine body 15 to pull the pull rod 58 to bias corresponding one of the first and second rocker arms 26 and 27 in the direction of abutment of the roller 36 or 46 against corresponding one of the first and second valve-operating cams 24 and 25.

With such constructions of the resilient biasing means 56 and 57, the pull rods 58 are pulled by the spring forces exhibited by the compression coil springs 59, whereby the first and second rocker arms 26 and 27 are biased in the direction of abutment of the rollers 36 and 46 against the first and second valve-operating cams 24 and 25. Thus, it is possible to make the resilient biasing means 56 and 57 more compact and to increase the degree of freedom of the design for the structure of the valve-operating system.

In the valve-operating system in which the first upper link arm 32 and the second upper link arm 42 each constituting a portion of each of the first and second lift-varying mechanisms 28 and 29 for varying the lift amounts of the first and second intake valves V1 and V2 are connected at one ends thereof to the first and second link arms 26 and 27, respectively, and supported at the other ends by the stationary support shaft 30, and the resilient biasing means 56 and 57 are mounted between the other ends of the first upper link arm 32 and the second upper link arm 42 and the support arms 62 provided on the cam holders 21 of the cylinder head 16, so that the lift amounts of the first and second intake valves V1 and V2 are changed, it is possible to suppress the looseness of a link mechanism constructed by the first and second rocker arms 26 and 27 and the pairs of link arms 32 and 33; 42 and 43 by the resilient biasing means 56 and 57 to suppress the vibration generated in the valve-operating system.

The hydraulic tappets 64 and 65 are each mounted to the one end of the first and second link arms 26 and 27 to abut against the first and second intake valves V1 and V2. Each of the hydraulic tappets 64 and 65 comprises: the bottomed cylindrical body 67 slidably mounted at the one end of each of the first and second link arms 26 and 27 with its closed end disposed on the side of each of the first and second intake valves V1 and V2; the plunger 68 slidably mounted in the body 67; the check valve 71 mounted at the one end of the plunger 68 and interposed between the high-pressure chamber 69 formed between the closed end of the body 67 and the one end of the plunger 68 and the oil chamber 70 formed within the plunger 68; and the return spring 72 mounted between the body 67 and the plunger 68 to exhibit the spring force for biasing the plunger 68 in the direction to increase the volume of the high-pressure chamber 69. The return spring 72 is disposed outward of the body 67 and hence, it is possible to decrease the volume of the high-pressure chamber 69, thereby decreasing the flow rate of the oil generated due to the operation, leading to a reduction in sizes of the hydraulic tappets 64 and 65.

Moreover, because the opposite ends of the coiled return spring 72 surrounding the plungers 68 are in engagement with the bodies 67 and the plungers 68, it is possible to maintain the assembled states of the bodies 67 and the plungers 68, and it is not required that rings for inhibiting the withdrawal of the plungers 68 from the bodies 67 are mounted to inner peripheries of the bodies 67. Therefore, it is possible to set the relatively large sealing length provided by the mutual sliding contact between the bodies 67 and the plungers 68, and to easily ensure a functionally required sealing length, while avoiding an increase in size of the entire hydraulic tappets 64 and 65.

The plunger 68 is provided at the other end thereof with the second press-fit bore 86 having at its axially outer end the tapered chamfer portion 86*a* having an axially outward increasing diameter, and the cap 87 integrally provided with the shaft portion 87*a* extending coaxially with the plunger 68 and the flange portion 87*b* coaxially connected to the shaft portion 87*a* is fixed to the other end of the plunger 68 by press-fitting the shaft portion 87*a* into the second press-fit bore 86 until the flange portion 87*b* is brought into opposed abutment against the other end face of the plunger 68 to close the end of the oil chamber 70 in the side opposite from the high-pressure chamber 69. By fixing the cap 87 in this manner, it is possible to accommodate the internal combustion engine adapted to be operated at a high speed.

Moreover, the notch 88 is provided in the outer periphery of the shaft portion 87*a* to extend axially so as to form the first air vent passage 89 leading to the oil chamber 70 between the notch 88 and the inner surface of the second press-fit bore 86, and the grooves 90 are provided, with their inner ends opening into the inner surface of the chamfer portion 86*a*, in the other end face of the plunger 68 to extend in the radial direction of the plunger 68 so as to form the second air vent passage 91 between the grooves 90 and the flange portion 87*b*. Therefore, when the cap 87 is fixed to the other end of the plunger 68, the first and second vent passages 89 and 91 can be brought into abutment against each other without matching of the phases of the notch 88 provided in the outer periphery of the shaft portion 87*a* of the cap 87 and the grooves 90 provided in the other end face of the plunger 68. Thus, it is possible to reliably perform the venting of air from the oil chamber 70 in the simple structure in which a complicated phase-matching operating is not required.

The check valve 71 comprises: the cage 80 mounted at the one end of the plunger 68 to form the valve chest 79 between the check valve 71 and the plunger 68; the tapered valve seat 81 provided on the plunger 68 so that it faces the valve chest 79 and the valve bore 76 leading to the oil chamber 70 opens into the central portion of the valve seat 81; and the spherical valve member 82 accommodated in the valve chest 79 so that it can be seated on the valve seat 81. The plurality of air vent bores 83 are provided in the plunger 68 so that their inner ends lead to the valve chest 79 at locations closer to the valve seat 81 and their outer ends open into the outer periphery of the plunger 68. Therefore, the air accumulated in the high-pressure chamber 69 can be reliably vented from the high-pressure chamber 69 in such a manner that it is pushed out through the clearance between the plunger 68 and the body 67 with an increase in pressure in the high-pressure chamber 69.

Further, the cage 80 is formed into a short cylindrical shape by grinding and press-fitted into the one end of the plunger 68. Thus, it is possible to enhance the dimensional accuracy of the cage 80, to enhance the accuracy of guiding of the valve member 82 and to reduce the volume of the high-pressure chamber 69 to provide an increase in rigidity. Moreover, the need for a component for exclusively fixing the cage 80 to the plunger 68 can be eliminated, leading to a reduction in the number of parts and a reduction in the number of steps of assembling the check valve 71.

In order to supply the oil through the oil passage 105 in the stationary support shaft 30 to the hydraulic tappets 64 and 65 mounted at the one ends of the first and second rocker arms 26 and 27, the first passages 106 and 120 are provided in the first upper link arm 32 and the second upper link arm 42 to lead to the oil passage 105, and the second passages 107 and 121 are provided in the first and second rocker arms 26 and 27 to lead to the hydraulic tappets 64 and 65. Further, the passage-forming members 109 and 123 are inserted into and fixed in the cylindrical upper connecting shafts 35 and 45 which rotatably connect the one ends of the first upper link arm 32 and the second upper link arm 42 to the first and second rocker arms 26 and 27, so that the communication passages 108 and 122 interconnecting the first and second passages 106, 120; 107, 121 are formed between the passage-forming members 109 and 123 and the inner peripheries of the upper connecting shafts 35 and 45.

With such a passage structure, the communication passages 108 and 122 for delivery of the oil between the first and second upper link arms 32 and 42 and the first and second rocker arms 26 and 27 can be formed in a simple and compact structure in which the passage-forming members 109 and 122 are merely inserted into and fixed in the upper connecting shafts 35 and 45. Moreover, the communication passages 108 and 123 are formed between the outer peripheries of the passage-forming members 109 and 123 and the inner peripheries of the upper connecting shafts 35 and 45 and hence, their volumes can be set at smaller values, and it is possible to avoid a reduction in the supply of the oil to the hydraulic tappets 64 and 65 which arises upon the restarting of the engine. Furthermore, the rigidity of the upper connecting shafts 35 and 45 reduced in weight by their cylindrical shapes can be increased by the insertion and fixing of the passage-forming members 109 and 123.

The annular recesses 111 are provided around the outer peripheries of the passage-forming members 109 and 123 to form the annular communication passages 108 and 122 between the inner surfaces of the upper connecting shafts 35 and 45 and the outer peripheries of the passage-forming members 109 and 123, and hence, the volumes of the communication passages 108 and 122 can be easily changed by virtue of the shapes of the annular recesses 111 provided around the outer peripheries of the passage-forming members 109 and 123, leading to an increase in degree of freedom of the design. Moreover, because the passage-forming members 109 and 123 are formed into the hollow cylindrical shapes, a reduction in weight can be achieved.

Further, the first annular grooves 113 leading to the first passages 106 and 120 are provided in the inner peripheries of the first fitting bores 112 which are provided in the first and second upper link arms 32 and 33, so that the upper connecting shafts 35 and 45 are fitted into the first fitting bores 112, and the second annular grooves 115 leading to the second passages 107 and 121 are provided in the inner peripheries of the second fitting bores 114 which are provided in the first and second rocker arms 26 and 27, so that the upper connecting shafts 35 and 45 are fitted into the second fitting bores 114. The pair of first communication bores 116 interconnecting the first annular grooves 113 and the communication passages 108 and 122 and the pair of second communication bores 117 interconnecting the second annular grooves 115 and the communication passages 108 and 122 are provided by boring in the upper connecting shafts 35 and 45 in such a manner that they are disposed on the diametrical lines which do not overlap each other, e.g., on the diametrical lines perpendicular to each other in this embodiment.

Therefore, even if the relative positions of the upper connecting shafts 35 and 45 about their axes relative to the first and second upper link arms 32 and 42 carried on the stationary shafts 30 as well as the first and second rocker arms 26 and 27 are any positions, there is an increased possibility that at least one of the first and second communication bores 116 and 117 is disposed at an uppermost location, and it is possible to facilitate the venting of the air accumulated in the communication passages 108 and 122. Moreover, the pairs of first and second communication passages 116 and 117 can be disposed on the diametrical lines of the upper connecting shafts 35 and 45 and thus, the workability of the first and second communication passages 116 and 117 can be enhanced.

To adjust the lift amounts for the first and second intake valves V1 and V2, the compression pressure within the combustion chamber is measured by the pressure gage 125 during cranking in the non-burned state of the engine, and the lift amounts for the first and second intake valves V1 and V2 are adjusted based on the measured value. The compression pressure in the engine is determined depending on the final amount of air drawn and hence, the amount of air drawn for every cylinder can be determined uniformly by adjusting the lift amounts for the first and second intake valves V1 and V2, so that the measured value of the compression pressure within the combustion chamber during cranking in the non-burned state of the engine is a predetermined value.

In addition, because the lift amount-adjusting mechanisms 97 and 98 for adjusting the lift amounts for the intake valves V1 and V2 are mounted in the engine body 15, the lift amounts for the intake valves V1 and V2 can be adjusted during cranking in the non-burned state of the engine. Further, because the hydraulic tappets 64 and 65 are mounted in the first and second rocker arms 26 and 27 so that they are interposed between the intake valves V1 and V2 and the lift amount-adjusting mechanisms 97 and 98, the lift amounts for the intake valves V1 and V2 are adjusted based on the compression pressure produced by the operation of the hydraulic tappets 64 and 65 in accordance with the cranking of the engine. Thus, even if the hydraulic tappets 64 and 65 are mounted in the rocker arms 26 and 27, the lift amounts for the intake valves V1 and V2 can be adjusted.

Further, the lift amounts for the intake valves V1 and V2 are variable. This can cause instability in the rotation of and misfiring of the engine when the variability of the lift amounts for the intake valves V1 and V2 are generated during the low-load operation of the engine. However, the amount of air drawn for every cylinder can be adjusted uniformly and hence, it is possible to reliably prevent the unstabilization of the rotation and the misfiring to more effectively achieve a reduction in fuel consumption and an enhancement in output during the low-load operation.

Although the embodiment of the present invention has been described in detail, the present invention is not limited to the above-described embodiment, and various modifications in design may be made without departing from the scope of the invention defined in the claims.

What is claimed is:

1. A valve-operating system for an internal combustion engine, comprising cam followers which have cam abutment portions abutting against valve-operating cams provided on a camshaft and which are swingably carried in an engine body and operatively connected to engine valves biased in a closing direction by a valve spring, the cam followers being biased in a direction of abutment of the cam abutment portions against the valve-operating cams by resilient biasing means different from the valve spring, wherein each of the resilient biasing means comprises: a pull rod connected at one end thereof to the cam follower; and a compression coil spring interposed between the other end of the pull rod and the engine body to pull the pull rod to bias the cam followers in a direction of abutment of the cam abutment portions against the valve-operating cams, wherein a pair of link arms are each connected at one end thereof to the cam follower, wherein the other end of one of the link arms is turnably carried in the engine body through a stationary support shaft having an axis parallel to an axis about which the cam follower is swung, and wherein the other end of the other link arm is turnably carried by a movable support shaft which has an axis parallel to the stationary support shaft and which is movable within a plane perpendicular to the axis; and the resiliently biasing means are mounted between the one link arm and the engine body.

2. A valve-operating system for an internal combustion engine comprising a cam follower which has a cam abutment portion abutting against a valve-operating cam provided on a camshaft and which is swingably carried in an engine body and operatively connected to an engine valve biased in a closing direction by a valve spring, the cam follower being biased in a direction of abutment of the cam abutment portion against the valve-operating cam by a resilient biasing means different from the valve spring, wherein the resilient biasing means comprises: a pull rod connected at one end thereof to the cam follower; and a compression coil spring interposed between the other end of the pull rod and the engine body to pull the pull rod to bias the cam follower in a direction of abutment of the cam abutment portion against the valve-operating cam, wherein a pair of link arms are each connected at one end thereof to the cam follower, wherein the other end of one of the link arms is turnably carried in the engine body through a stationary support shaft having an axis parallel to an axis about which the cam follower is swung, and wherein the other end of the other link arm is turnably carried by a movable support shaft which has an axis parallel to the stationary support shaft and which is movable within a plane perpendicular to the axis; and the resiliently biasing means are mounted between the one link arm and the engine body.

* * * * *